US008089015B2

(12) United States Patent
Ozias et al.

(10) Patent No.: US 8,089,015 B2
(45) Date of Patent: Jan. 3, 2012

(54) KEYBOARD WITH INTEGRATED ELECTROLUMINESCENT ILLUMINATION

(75) Inventors: Orin Michael Ozias, Austin, TX (US); Kevin Warren Mundt, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 517 days.

(21) Appl. No.: 12/113,382

(22) Filed: May 1, 2008

(65) Prior Publication Data

US 2009/0272638 A1 Nov. 5, 2009

(51) Int. Cl.
*H01H 9/00* (2006.01)

(52) U.S. Cl. ..... 200/314; 200/341

(58) Field of Classification Search ..... 200/314
See application file for complete search history.

(56) References Cited

U.S. PATENT DOCUMENTS 5,491,313 A * 2/1996 Bartley et al. ..... 200/310
6,554,442 B2 4/2003 Chou ..... 362/85
6,797,902 B2 9/2004 Farage et al. ..... 200/314
6,987,466 B1 * 1/2006 Welch et al. ..... 341/22
7,235,752 B1 * 6/2007 Chen et al. ..... 200/310
7,258,469 B2 * 8/2007 Manico et al. ..... 362/394
7,273,993 B1 * 9/2007 Tanner et al. ..... 200/314

FOREIGN PATENT DOCUMENTS

JP 62211897 A * 9/1987

* cited by examiner

*Primary Examiner* — Elvin G Enad
*Assistant Examiner* — Lisa Klaus
(74) *Attorney, Agent, or Firm* — Baker Botts L.L.P.

(57) ABSTRACT

An electroluminescent switch membrane for use in a keyboard associated with an information handling system is disclosed. The electroluminescent switch membrane may include a first and a second sheet of film configured as opposing electrodes of a capacitor. The switch membrane may include an electroluminescent material disposed between the two sheets of film. The switch membrane may include a plurality of conductive traces printed on the first sheet of film. The switch membrane may include a plurality of switches disposed on the first sheet of film, each switch configured to complete a respective circuit with the conductive traces when the switch is depressed. In addition, the electroluminescent switch membrane may be configured to illuminate the keyboard when an electric current is passed through the electroluminescent material.

20 Claims, 6 Drawing Sheets

KEYBOARD WITH INTEGRATED ELECTROLUMINESCENT ILLUMINATION

TECHNICAL FIELD

The present disclosure relates in general to keyboards for use with information handling systems, and more particularly to keyboards with integrated electroluminescent illumination.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

FIG. 1 depicts selected elements of an example prior art information handling system 1. Information handling system 1 includes a host 10, which may include processing resources (e.g., one or more central processing units (CPUs) and storage resources that are accessible to the processing resources) in a housing 12. Storage resources may include volatile storage or memory and/or persistent storage, e.g., disk storage, flash memory or other type of erasable read only memory (ROM), and the like. Information handling system 1 may also include various other peripheral or I/O devices known in the field of data processing system design, such as mouse 14 and display 20 shown in FIG. 1.

Host 10 may include a keyboard 30. As shown in FIG. 1, keyboard 30 may include a set of keycaps (and/or buttons) 32 operable to provide input to host 10. One example of keyboard 30 includes a set of keycaps 32 arranged in the so-called "QWERTY" character set, which has been used for typewriters. In a standard keyboard 30, keycaps 32 display one or more imprinted characters, for example, characters corresponding to alphanumeric characters, mathematical functions, and/or specialized function keys.

Information handling system 1 may include a mobile information handling device, e.g., laptop 10 shown in FIG. 2 or any other type of mobile computing device (e.g., a tablet computer, a notebook computer, a PDA, a cellphone, etc.). Case 12 may include any chassis, cabinet, tower, box, and/or enclosure appropriate for housing information handling system 1. Display 20 may include any information display for visual presentation of images, texts, and/or other output from information handling system 1. Keyboard 30 may include any arrangement of buttons and/or keys designed for the input of text, characters, and/or operational controls for information handling system 1. Keyboard 30 may include individual keycaps 32.

Laptop 10 may also include processing resources, e.g., one or more central processing units (CPUs) and storage resources that are accessible to the processing resources. Storage resources may include volatile storage or memory and/or persistent storage, e.g., disk storage, flash memory or other type of erasable read only memory (ROM), and the like.

FIGS. 3 and 4*a*-4*b* show some of the construction details of a typical keyboard 30, including keycaps 32, a scissor mechanism 34, a cosmetic mask 36, a switch membrane 40, electronic circuit traces 42, a dome switch 44, a ribbon connector 46, and a base plate 50.

Base plate 50 is often made of metal and provides structure for keyboard 30. In addition, base plate 50 provides mounting points for other components of keyboard 30. Switch membrane 40 is disposed between base plate 50 and keycaps 32. Switch membrane 40 is often made of plastic film. Electronic circuit traces 42 are printed on the surface of switch membrane 40. Electronic circuit traces 42 are typically printed with silver ink onto switch membrane 40.

Dome switch 44 is a commonly used switch sometimes called a "direct-switch" mechanism. Dome switch 44 is positioned beneath keycap 32 and collapses between base plate 50 and keycap 32 when keycap 32 is depressed by a user. The inner surface of dome switch 44 is coated with an electrically conductive material, so when dome switch 44 collapses, the conductive material completes a circuit between electronic circuit traces 42 printed on switch membrane 40.

In keyboard 30 incorporating scissor mechanism 34, keycaps 32 are typically attached to keyboard 30 using two plastic arms that interlock like scissors. Scissor mechanism 34 snap connects to both keyboard 30 and keycap 32. Cosmetic mask 36 typically conceals portions of keyboard 30 from a user's line-of-sight.

FIG. 4*b* illustrates an example prior art switch membrane 40 with electronic circuit traces 42, dome switches 44, and ribbon connector 46 for use in keyboard 30. Switch membrane 40 includes a plurality of switches (e.g., dome switches 44). Ribbon connector 46 is an electrical connection between electronic circuit traces 42 and host 10 or information handling system 1. Switch membrane 40 is perforated as shown in FIG. 4*b* so that scissor mechanisms 34 can be connected to base plate 50 through the perforations.

FIG. 5 illustrates an example electroluminescent panel 60 (EL Panel) that is used to provide backlighting for some keyboards. EL Panel 60 includes holes 62 and a lead 64. In general, an electroluminescent panel typically includes two sheets of plastic film bonded together to form a capacitor. The space between the two sheets is typically filled with an electroluminescent material (e.g., powder phosphor, zinc sulfide, etc.). Electroluminescent materials emit light in response to an electric current passing through the material. EL Panel 60 emits light in response to application of current across the capacitor formed by the sheets of plastic film. EL Panel 60 is perforated with holes 62 so that scissor mechanisms 34 may connect keycaps 32 to base plate 50 and/or so that dome switches 44 may protrude through EL Panel 60. Lead 64 provides an electrical connection between EL Panel 60 and other portions of keyboard 30 to provide electric current to the electroluminescent material.

Other keyboards provide backlighting through the use of light emitting diodes (LED) that illuminate a large sheet by edge lighting. Such a solution, however, typically consumes a great deal of power and adds bulk and weight to a keyboard.

LED solutions may not be satisfactory for use in a mobile information handling system where size and weight are important design parameters.

SUMMARY

In accordance with one embodiment of the present disclosure, an electroluminescent switch membrane for use in a keyboard associated with an information handling system is disclosed. The electroluminescent switch membrane may include a first and a second sheet of film configured as opposing electrodes of a capacitor. The switch membrane may include an electroluminescent material disposed between the two sheets of film. The switch membrane may include a plurality of conductive traces printed on the first sheet of film. The switch membrane may include a plurality of switches disposed on the first sheet of film, each switch configured to complete a respective circuit with the conductive traces when the switch is depressed. In addition, the electroluminescent switch membrane may be configured to illuminate the keyboard when an electric current is passed through the electroluminescent material.

In accordance with a further embodiment of the present disclosure, a keyboard configured for use with an information handling system may include a first and a second sheet of film configured as opposing electrodes of a capacitor, an electroluminescent material disposed between the two sheets of film, a plurality of conductive traces printed on the first sheet of film, a plurality of keycaps disposed above the first sheet of film, and a plurality of switches disposed between the keycaps and the first sheet of film, each switch configured to complete a respective circuit with the conductive traces when the respective keycap is depressed. The electroluminescent material may be configured to illuminate the keyboard when an electric current is passed through the electroluminescent material.

In accordance with another embodiment of the present disclosure, an information handling system may include a processor, a memory communicatively coupled to the processor, and a keyboard configured to communicate electrical signals to the processor in response to user input. The keyboard may include a first and a second sheet of film configured as opposing electrodes of a capacitor, an electroluminescent material disposed between the two sheets of film, a plurality of conductive traces printed on the first sheet of film, a plurality of keycaps disposed above the first sheet of film, and a plurality of switches disposed between the keycaps and the first sheet of film, each switch configured to complete a respective circuit with the conductive traces when the respective keycap is depressed. The electroluminescent material may be configured to illuminate the keyboard when an electric current is passed through the electroluminescent material.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1-7*c*, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

Figure 1:
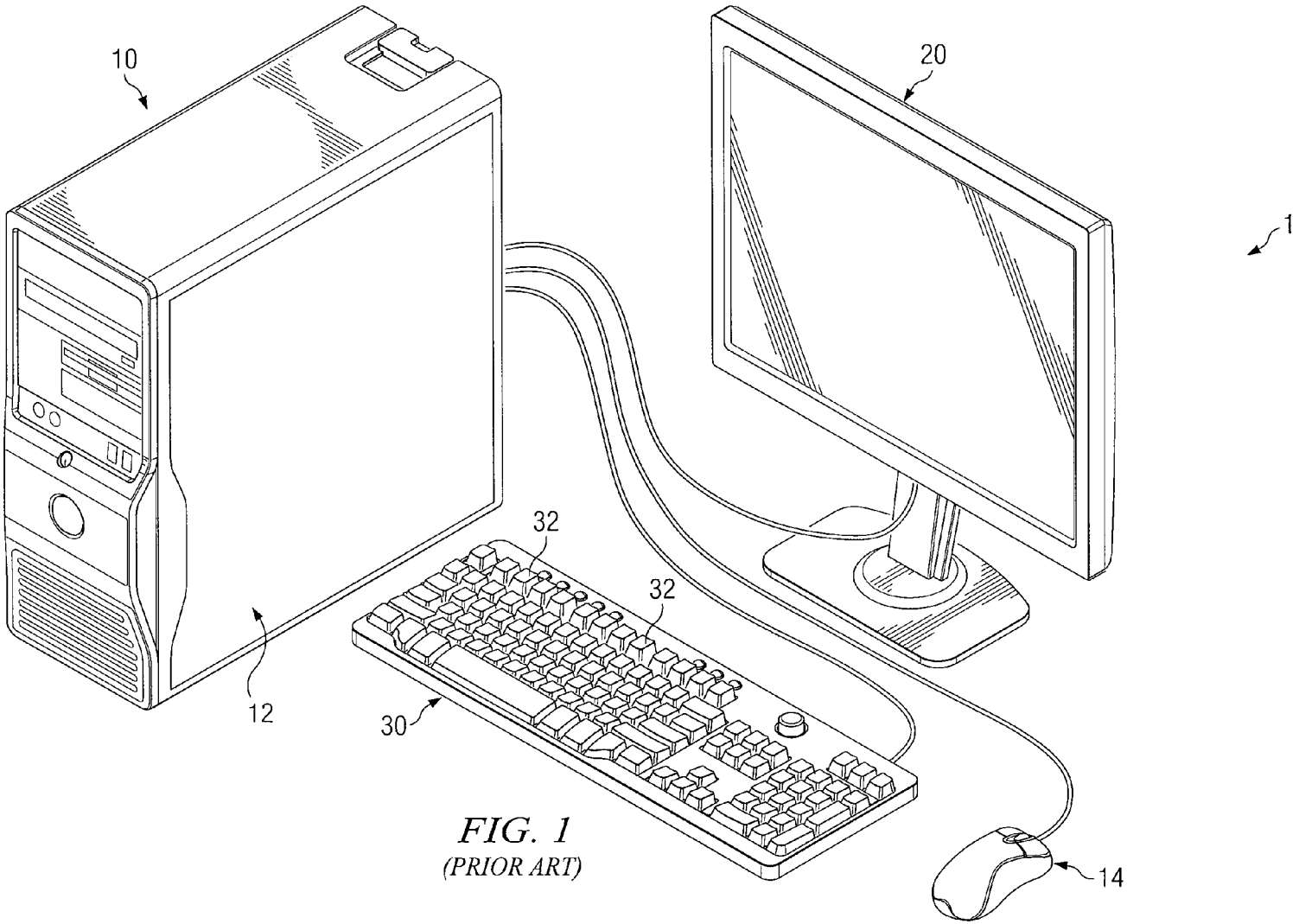
FIG. 1 (PRIOR ART)
FIG. 1 illustrates an example prior art information handling system.
Figure 2:
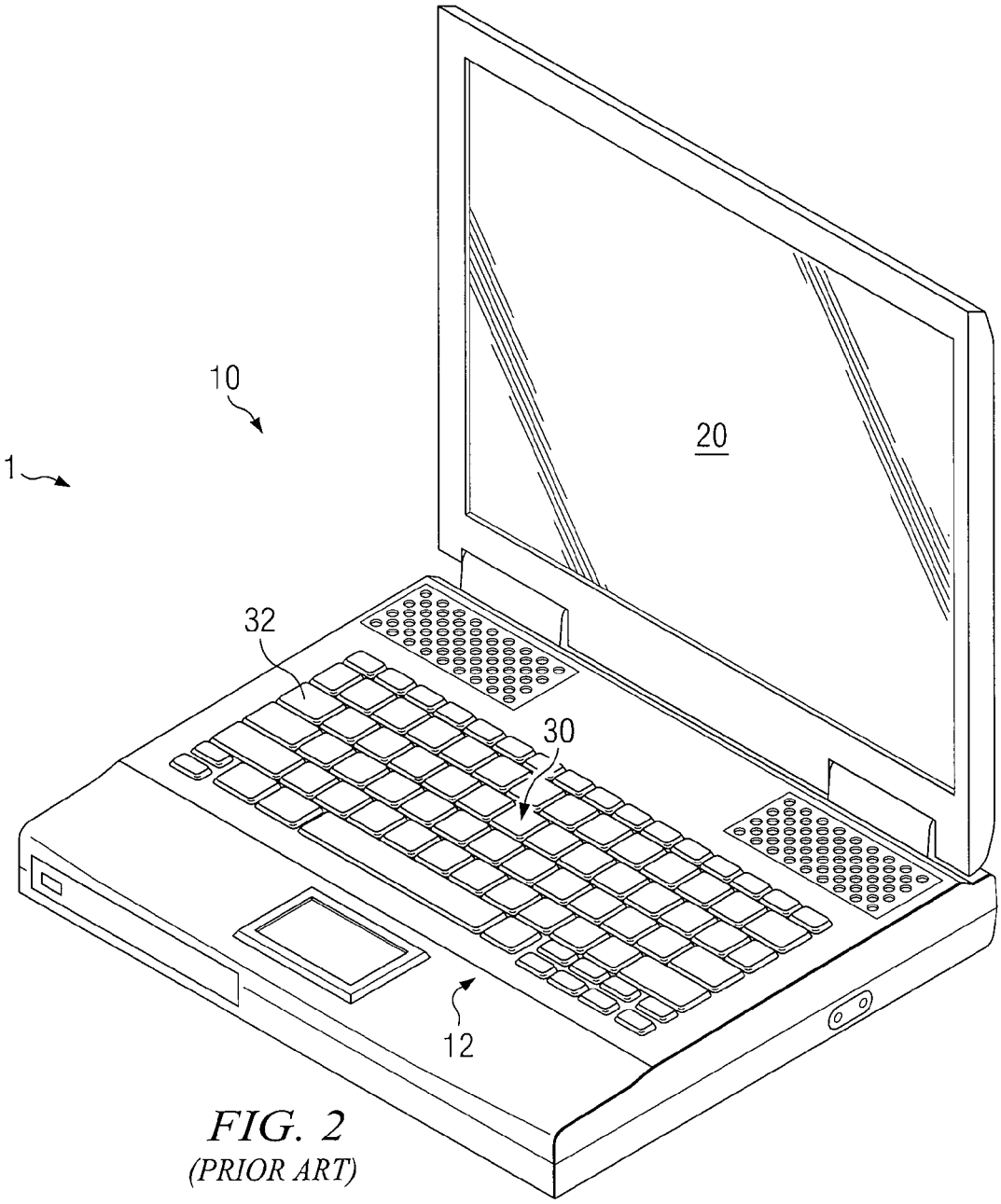
FIG. 2 (PRIOR ART)
FIG. 2 illustrates an example prior art information handling system.
Figure 3:
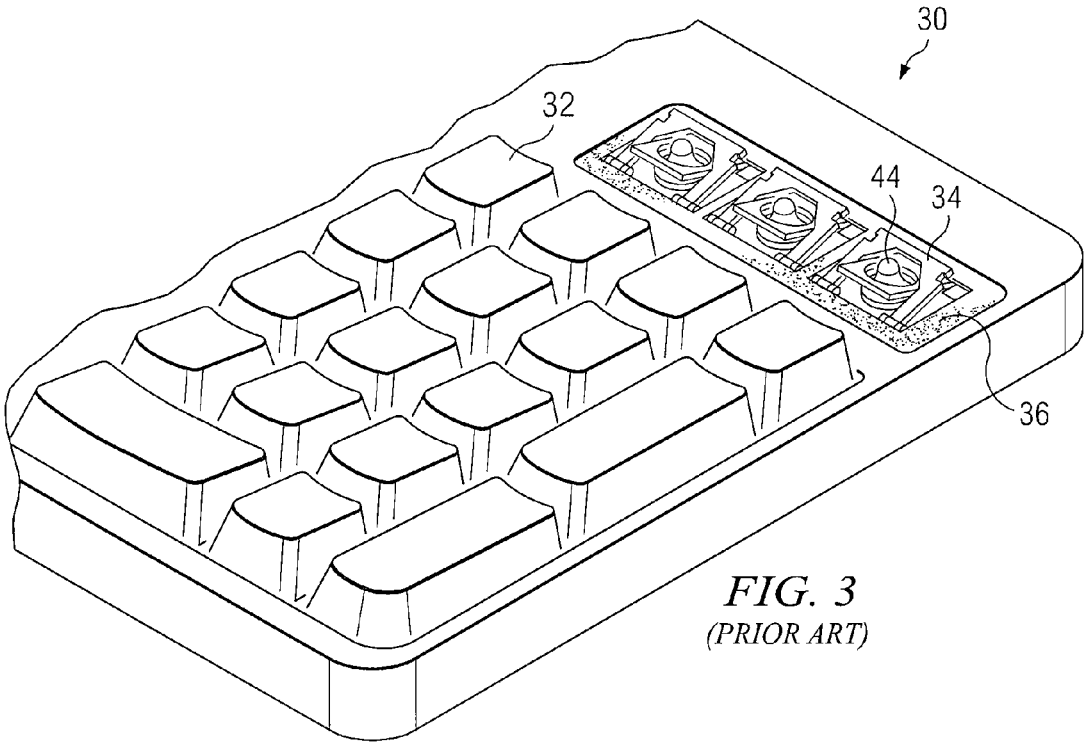
FIG. 3 (PRIOR ART)
FIG. 3 illustrates an example prior art keyboard for use with an information handling system.
Figure 4A:
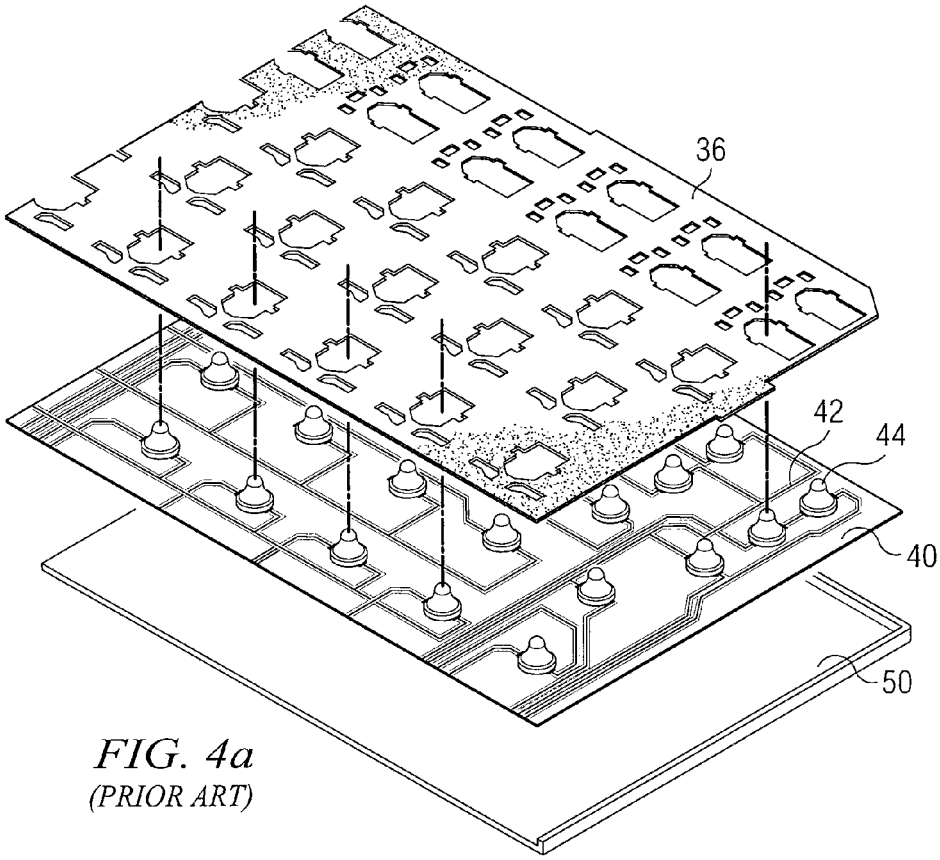
FIG. 4a (PRIOR ART)
FIG. 4*a* illustrates selected components of an example prior art keyboard for use with an information handling system.
Figure 4B:
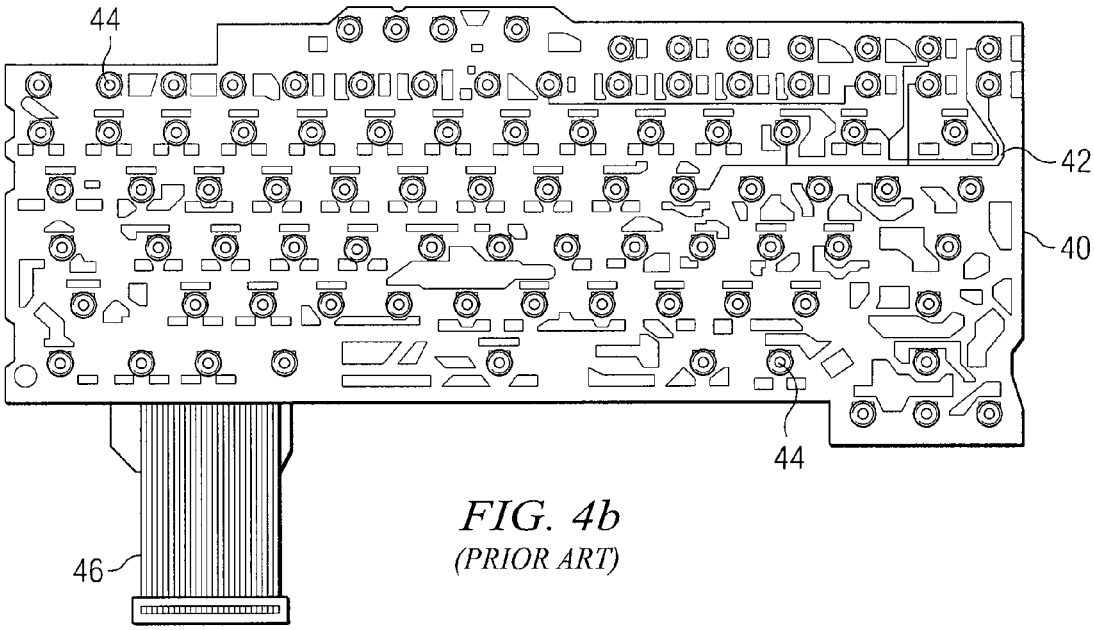
FIG. 4b (PRIOR ART)
FIG. 4*b* illustrates an example switch membrane for use in a keyboard.
Figure 5:
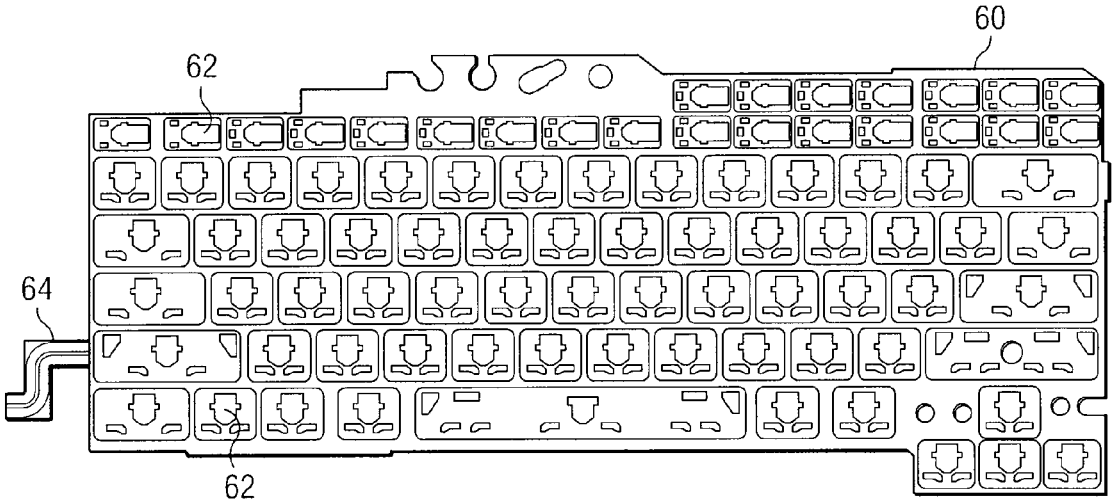
FIG. 5 (PRIOR ART)
FIG. 5 illustrates an example electroluminescent panel for use in a keyboard.
Figure 6A:
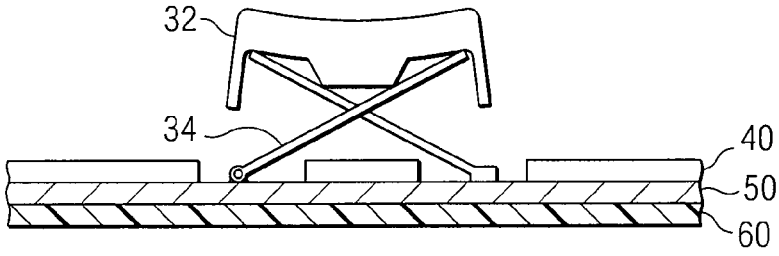
FIGS. 6*a*-6*c* illustrate three example constructions for illuminated keyboards.
Figure 6B:
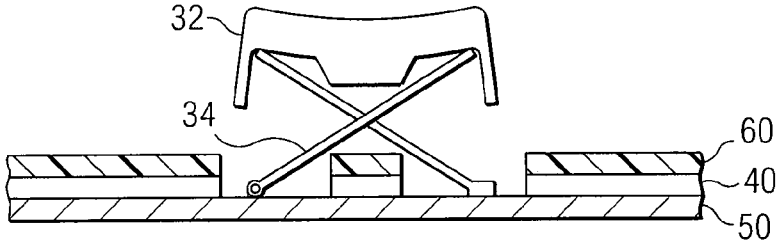
Figure 6C:
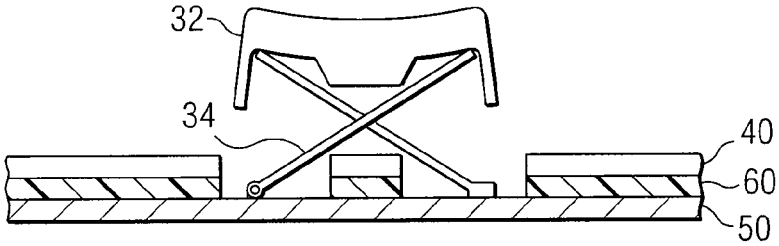

FIGS. 6*a*-6*c* illustrate three example constructions for illuminated keyboards. As shown in FIGS. 6*a*-6*c*, keycap 32 may be connected to base plate 50 by scissor mechanism 34. Any layer interposed between keycap 32 and base plate 50 must be perforated to accommodate scissor mechanism 34. For example, in FIG. 6*a*, switch membrane 40 must be perforated. In FIGS. 6*b* and 6*c*, both switch membrane 40 and EL Panel 60 must be perforated to accommodate scissor mechanism 34. When EL Panel 60 is perforated, it reduces the illuminated surface area of EL Panel 60 and may reduce the light emitted from EL Panel 60.

In examples such as that shown in FIG. 6*a*, EL Panel 60 is positioned below base plate 50. This arrangement allows EL Panel 60 to be installed without perforation. However, base plate 50 must either be transparent to light or perforated to allow light to pass through. Most base plates 50 used in keyboards 30 are formed of solid metal. It is estimated that base plate 50, even if perforated, blocks more than one-half of the illuminated surface of EL Panel 60.

Figure 7A:
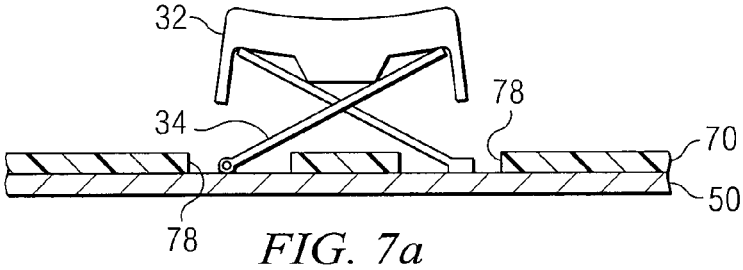
FIGS. 7*a*-7*c* illustrate an example construction for an illuminated keyboard in accordance with the present disclosure.
Figure 7B:
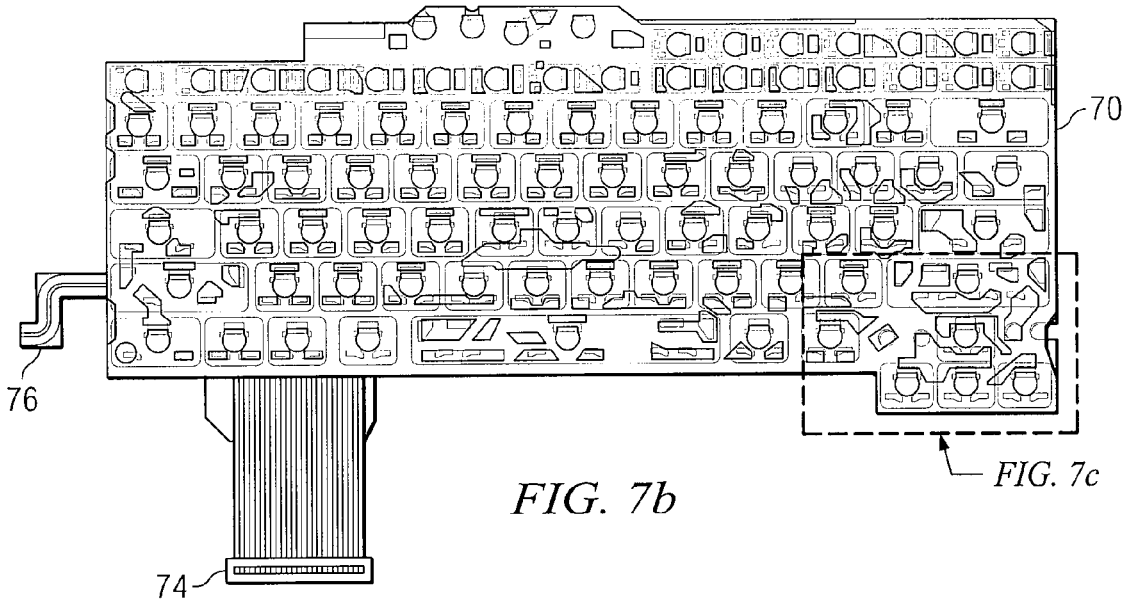
Figure 7C:
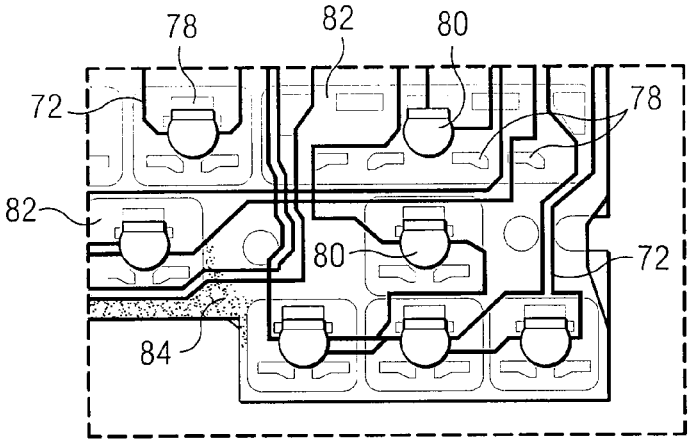

FIGS. 7*a*-7*c* illustrate an example construction for an illuminated keyboard in accordance with the present disclosure. As shown in FIG. 7*a*, the present disclosure allows an illuminated keyboard including fewer components that the constructions discussed in relation to FIGS. 6*a*-6*c*. The illuminated keyboard may include keycap 32, scissor mechanism 34, base plate 50, and an electroluminescent switch membrane 70.

Keycap 32 and scissor mechanism 34 may be any device, feature, or component of a keyboard configured to cooperate to allow a keyboard to recognize user input (e.g., complete an electronic circuit when keycap 32 is depressed). Keycap 32 may be made of plastic or any other suitable material. In some embodiments, keycap 32 may be molded in a clear or translucent material. Keycap 32 may be painted with an opaque material then characters etched within the opaque material. Illumination on keycap 32 from below will pass through keycap 32 and may be seen by a user.

Scissor mechanism 34 may be any structure or device configured to connect keycap 32 to base plate 50, to support keycap 32 in a raised position, to allow a user to depress keycap 32, and to return keycap 32 to its raised position after the user has removed his or her finger. Scissor mechanism may include plastic, metal, or any other appropriate material.

Base plate 50 may include any material configured to connect with scissor mechanism 34 and allow mounting of keycap 32 on base plate 50. For example, base plate 50 may include a flat sheet of metal (e.g., aluminum and/or steel). As another example, base plate 50 may include a sheet of rigid plastic. In mobile information handling devices, the thickness and/or material selection of base plate 50 may be chosen to reduce the weight of the mobile information handling device. As shown in FIG. 7*a*, base plate 50 is positioned below electroluminescent switch membrane 70, so base plate 50 need not be perforated to allow light to pass therethrough.

As shown in FIGS. 7*b* and 7*c*, electroluminescent switch membrane 70 may include electronic circuit traces 72, a connector 74, a lead 76, holes 78, dome switches 80, electroluminescent illuminated areas 82, and a cosmetic mask 84. Electroluminescent switch membrane 70 may include any device or component configured to operate in conjunction with keycap 32 and scissor mechanism 34 to provide user input to a keyboard and configured to provide electroluminescent backlighting to keycaps 32 and/or the keyboard.

For example, electroluminescent switch membrane 70 may include one or more plastic sheets (e.g., mylar) including electronic circuit traces 72. Electronic circuit traces 72 may be any component or feature of electroluminescent switch membrane 70 configured to conduct electricity between dome switches 80 and other components of a keyboard. When dome switches 80 are activated, one or more circuits may be completed on electronic circuit traces 72. In some example embodiments, electronic circuit traces 72 may be printed onto electroluminescent switch membrane in silver ink.

Connector 74 may include any cable or wire configured to communicate electric signals from electroluminescent switch membrane 70 to other portions of a keyboard or an information handling system. For example, connector 74 may include an insulation displacement connector (IDC) or a solder-bucket connection providing electrical contacts for a ribbon cable. Connector 74 may be chosen for compatibility with software, firmware, or hardware related to the operation of a keyboard. Connector 74 may be configured to communicate the electrical signals generated when keycap 32 is depressed.

Lead 76 may include any cable or wire configured to communicate electrical signals from electroluminescent switch membrane 70 to other portions of a keyboard or an information handling system. For example, lead 76 may include a length of wire, a soldering pad, pins, and/or any other component operable to provide power to electroluminescent switch membrane 70 for use in illumination. In other embodiments, connector 74 and lead 76 may be integrated to provide a single connection between electroluminescent switch membrane and other components of a keyboard or an information handling system.

Holes 78 may include any portion of electroluminescent switch membrane 70 configured to allow physical passage of components of a keyboard. For example, holes 78 may be configured to allow scissor mechanism 34 to pass through electroluminescent switch membrane 70 and connect to base plate 50.

Dome switches 80 may include any component or feature of electroluminescent switch membrane 70 configured to collapse between base plate 50 and keycap 32 when keycap 32 is depressed by a user. Each dome switch 80 may be positioned beneath a keycap 32. The inner surface of each dome switch 38 may be coated with an electrically conductive material, so when the dome switch 38 collapses, the conductive material completes a circuit between electronic circuit traces 72 of electroluminescent switch membrane 70. In other embodiments, electroluminescent switch membrane 70 may include scissor switches, capacitive switches, mechanical switches, buckling spring switches, hall-effect switches, and/or laser switches to complete an electrical circuit in conjunction with electronic circuit traces 72.

Electroluminescent illuminated areas 82 may include portions of electroluminescent switch membrane 70 configured to emit light in response to an electric current passing through electroluminescent material within electroluminescent switch membrane 70. In some embodiments, electroluminescent switch membrane may include two sheets of plastic film bonded together to form a capacitor. The space between the two sheets may be filled with an electroluminescent material (e.g., powder phosphor, zinc sulfide, etc.).

Cosmetic mask 84 may include any portion of electroluminescent switch membrane 70 configured to block light from passing through. For example, cosmetic mask 84 may include portions of electroluminescent switch membrane 70 not including electroluminescent material so that light is not emitted from those portions. As another example, cosmetic mask 84 may be an opaque material printed on or otherwise disposed on or in electroluminescent switch membrane 70 so that illumination will not pass through cosmetic mask 84.

The example construction shown in FIGS. 7*a*-7*c* may offer improvements over the constructions shown in FIGS. 6*a*-6*c*. For example, electroluminescent switch membrane 70 reduces the number of layers of material included in the assembly, which may reduce the cost of manufacturing, the height of the stack, the weight of the construction, and/or provide additional benefits related to the elimination of extra material. As another example, electroluminescent switch membrane 70 may have fewer holes than EL Panel 60, which may allow for more illumination surface area.

Although the present disclosure has been described in detail, it should be understood that various changes, substitutions, and alterations can be made hereto without departing from the spirit and the scope of the disclosure as defined by the appended claims.

What is claimed is:

1. An electroluminescent switch membrane for use in a keyboard associated with an information handling system, comprising:

a first and a second sheet of film configured as opposing electrodes of a capacitor;

an electroluminescent material disposed between the two sheets of film, without an associated insulating layer between the two sheets of film;

a plurality of conductive traces printed on a first side of the first sheet of film opposite the electroluminescent material; and a plurality of switches disposed on the first side of the first sheet of film, each switch configured to complete a respective circuit with the conductive traces when the switch is depressed, the respective circuit being entirely printed on the first side of the first sheet of film; and wherein the electroluminescent switch membrane is configured to illuminate the keyboard when an electric current is passed through the electroluminescent material.

2. An electroluminescent switch membrane 1 according to claim 1, wherein the electroluminescent material comprises powder phosphor.

3. An electroluminescent switch membrane according to claim 1, wherein the electroluminescent material comprises zinc sulfide.

4. An electroluminescent switch membrane according to claim 1, wherein the plurality of switches comprise dome switches.

5. An electroluminescent switch membrane according to claim 1, wherein the plurality of conductive traces comprise silver ink.

6. An electroluminescent switch membrane according to claim 1, wherein the first sheet of film comprises mylar.

7. A keyboard configured for use with an information handling system, the keyboard comprising:

a first and a second sheet of film configured as opposing electrodes of a capacitor;

an electroluminescent material disposed between the two sheets of film, without an associated insulating layer between the two sheets of film;

a plurality of conductive traces printed on a first side of the first sheet of film opposite the electroluminescent material;

a plurality of keycaps disposed above the first sheet of film; and a plurality of switches disposed between the keycaps and the first sheet of film, each switch configured to complete a respective circuit with the conductive traces when the respective keycap is depressed, the respective circuit being entirely printed on the first side of the first sheet of film; and wherein the electroluminescent material is configured to illuminate the keyboard when an electric current is passed through the electroluminescent material.

8. A keyboard according to claim 7, wherein the electroluminescent material comprises powder phosphor.

9. A keyboard according to claim 7, wherein the electroluminescent material comprises zinc sulfide.

10. A keyboard according to claim 7, wherein the plurality of switches comprise dome switches.

11. A keyboard according to claim 7, wherein the plurality of switches comprise buckling springs.

12. A keyboard according to claim 7, wherein the plurality of switches comprise scissor switches.

13. A keyboard according to claim 7, wherein the first sheet of film comprises mylar.

14. An information handling system comprising:

a processor;

a memory communicatively coupled to the processor; and a keyboard configured to communicate electrical signals to the processor in response to user input, the keyboard comprising:

a first and a second sheet of film configured as opposing electrodes of a capacitor;

an electroluminescent material disposed between the two sheets of film, without an associated insulating layer between the two sheets of film;

a plurality of conductive traces printed on a first side of the first sheet of film;

a plurality of keycaps disposed above the first sheet of film; and a plurality of switches disposed between the keycaps and the first sheet of film, each switch configured to complete a respective circuit with the conductive traces when the respective keycap is depressed, the respective circuit being entirely printed on the first side of the first sheet of film; and wherein the electroluminescent material is configured to illuminate the keyboard when an electric current is passed through the electroluminescent material.

15. An information handling system according to claim 14, wherein the electroluminescent material comprises powder phosphor.

16. An information handling system according to claim 14, wherein the electroluminescent material comprises zinc sulfide.

17. An information handling system according to claim 14, wherein the plurality of switches comprise dome switches.

18. An information handling system according to claim 14, wherein the plurality of switches comprise buckling springs.

19. An information handling system according to claim 14, wherein the plurality of switches comprise scissor switches.

20. An information handling system according to claim 14, wherein the first sheet of film comprises mylar.

* * * * *